US009732404B2

(12) United States Patent
Barges et al.

(10) Patent No.: US 9,732,404 B2
(45) Date of Patent: Aug. 15, 2017

(54) METHOD OF PRODUCING HIGH-STRENGTH STEEL PLATES WITH EXCELLENT DUCTILITY AND PLATES THUS PRODUCED

(75) Inventors: Patrick Barges, Roserieulles (FR); Colin Scott, Montigny les Metz (FR); Gerard Petitgand, Plesnois (FR); Fabien Perrard, Metz (FR)

(73) Assignee: ArcelorMittal France, Saint Denis (FR)

( * ) Notice: Subject to any disclaimer, the term of this patent is extended or adjusted under 35 U.S.C. 154(b) by 1585 days.

(21) Appl. No.: 11/997,609

(22) PCT Filed: Jul. 7, 2006

(86) PCT No.: PCT/FR2006/001668
§ 371 (c)(1),
(2), (4) Date: Apr. 25, 2008

(87) PCT Pub. No.: WO2007/017565
PCT Pub. Date: Feb. 15, 2007

(65) Prior Publication Data

US 2008/0199347 A1 Aug. 21, 2008

(30) Foreign Application Priority Data

Aug. 4, 2005 (EP) ..... 05291675

(51) Int. Cl.

| | |
|---|---|
| ***C22C 38/04*** | (2006.01) |
| ***C22C 38/00*** | (2006.01) |
| ***C22C 38/02*** | (2006.01) |
| ***C22C 38/12*** | (2006.01) |
| ***C22C 38/14*** | (2006.01) |

(52) U.S. Cl.
CPC ..... *C22C 38/001* (2013.01); *C22C 38/02* (2013.01); *C22C 38/04* (2013.01); *C22C 38/12* (2013.01); *C22C 38/14* (2013.01)

(58) Field of Classification Search
CPC ..... C22C 38/01; C22C 38/02
USPC ..... 148/602
See application file for complete search history.

(56) References Cited

U.S. PATENT DOCUMENTS

| | | | | |
|---|---|---|---|---|
| 5,470,529 | A * | 11/1995 | Nomura et al. | 420/103 |
| 6,706,419 | B2 * | 3/2004 | Yoshinaga et al. | 428/659 |
| 7,736,449 | B2 | 6/2010 | Takada et al. | |
| 2005/0133124 | A1 * | 6/2005 | Kawano et al. | 148/546 |
| 2005/0199322 | A1 * | 9/2005 | Nakamura et al. | 148/636 |
| 2005/0247378 | A1 * | 11/2005 | Ikeda et al. | 148/320 |

FOREIGN PATENT DOCUMENTS

| | | | |
|---|---|---|---|
| EP | 0 974 677 | | 1/2000 |
| EP | 1 099 769 | | 5/2001 |
| EP | 1 375 820 | | 1/2004 |
| EP | 1 559 798 | | 8/2005 |
| JP | H01230715 | A | 9/1989 |
| JP | H02217425 | A | 8/1990 |
| JP | 2001 152254 | | 6/2001 |
| JP | 2004143518 | A * | 5/2004 |
| JP | 2006517257 | A | 7/2006 |
| WO | 2004 063410 | | 7/2004 |

* cited by examiner

*Primary Examiner* — Jessee Roe
*Assistant Examiner* — Christopher Kessler
(74) *Attorney, Agent, or Firm* — Davidson, Davidson & Kappel, LLC; Jennifer L. O'Connell; William Gehris

(57) ABSTRACT

Steel sheet, the composition of the steel of which comprises, the contents being expressed by weight: 0.08%≤C≤0.23%, 1%≤Mn≤2%, 1≤Si≤2%, Al≤0.030%, 0.1%≤V≤0.25%, Ti≤0.010%, S≤0.015%, P≤0.1%, 0.004%≤N≤0.012%, and, optionally, one or more elements chosen from: Nb≤0.1%, Mo≤0.5%, Cr≤0.3%, the balance of the composition consisting of iron and inevitable impurities resulting from the smelting.

34 Claims, No Drawings

METHOD OF PRODUCING HIGH-STRENGTH STEEL PLATES WITH EXCELLENT DUCTILITY AND PLATES THUS PRODUCED

FIELD OF THE INVENTION

The invention relates to the manufacture of steel sheet, more particularly TRIP (Transformation Induced Plasticity) steel sheet, that is to say in which the steel exhibits plasticity induced by an allotropic transformation.

BACKGROUND

In the automobile industry, there is a continual need to lighten vehicles, resulting in a search for steels of higher yield strength or tensile strength. Thus, high-strength steels have been proposed that contain microalloying elements. Hardening is obtained at the same time by precipitation and by refinement of the grain size.

With the objective of obtaining even higher strength levels, TRIP steels have been developed that exhibit advantageous combinations of properties (strength/deformability). These properties are attributed to the structure of such steels, consisting of a ferrite matrix containing bainite and residual austenite phases. In hot-rolled sheet, the residual austenite is stabilized thanks to an increase in the content of elements such as silicon and aluminium, these elements retarding the precipitation of carbides in the bainite. Cold-rolled sheet made of TRIP steel is manufactured by reheating the steel, during the annealing, into a region where partial austenization occurs, followed by rapid cooling in order to avoid the formation of pearlite and then an isothermal soak in the bainite region: one portion of the austenite is converted to bainite while another portion is stabilized by the increase in carbon content of the residual austenite islands. Thus, the initial presence of ductile residual austenite is associated with a high deformability. Under the effect of subsequent deformation, for example during a drawing operation, the residual austenite of a part made of TRIP steel is progressively transformed to martensite, resulting in substantial hardening. A steel exhibiting TRIP behaviour therefore makes it possible to guarantee a high deformability and a high strength, these two properties usually being mutually exclusive. This combination provides the potential for high energy absorption, a quality typically sought in the automobile industry for impact-resistant parts.

Carbon plays an important role in the manufacture of TRIP steels: firstly, its presence in sufficient quantity within the residual austenite islands is necessary so that the local martensitic transformation temperature is lowered to below the ambient temperature. Secondly, it is usually added in order to increase the strength inexpensively.

However, this addition of carbon must remain limited in order to guarantee that the weldability of the products remains satisfactory, otherwise the ductility of welded assemblies and the cold cracking resistance are reduced. What is therefore sought is a manufacturing process for increasing the strength of TRIP steel sheet, in particular to above about 900-1100 MPa for a carbon content of around 0.2% by weight, without the total elongation being reduced to below 18%. An increase in strength of more than 100 MPa over the current levels is desirable.

It is also desirable to obtain a process for manufacturing hot-rolled or cold-rolled steel sheet which is largely insensitive to small variations in the industrial manufacturing conditions, in particular to temperature variations. Thus, it is sought to obtain a product characterized by a microstructure and mechanical properties that are largely insensitive to small variations in these manufacturing parameters. It is also sought to obtain a very tough product offering excellent fracture resistance.

SUMMARY

The object of the present invention is to solve the above-mentioned problems.

For this purpose, the subject of the invention is a composition for the manufacture of steel exhibiting TRIP behaviour, comprising, the contents being expressed by weight: $0.08\% \leq C \leq 0.23\%$, $1\% \leq Mn \leq 2\%$, $1 \leq Si \leq 2\%$, $Al \leq 0.030\%$, $0.1\% \leq V \leq 0.25\%$, $Ti \leq 0.010\%$, $S \leq 0.015\%$, $P \leq 0.1\%$, $0.004\% \leq N \leq 0.012\%$, and, optionally, one or more elements chosen from: $Nb \leq 0.1\%$, $Mo \leq 0.5\%$, $Cr \leq 0.3\%$, the balance of the composition consisting of iron and inevitable impurities resulting from the smelting.

Preferably, the carbon content is such that: $0.08\% \leq C \leq 0.13\%$.

According to a preferred embodiment, the carbon content is such that: $0.13\% < C \leq 0.18\%$.

Also preferably, the carbon content is such that $0.18\% < C \leq 0.23\%$.

Preferably, the manganese content is such that: $1.4\% \leq Mn \leq 1.8\%$.

Also preferably, the manganese content satisfies the relationship: $1.5\% \leq Mn \leq 1.7\%$.

Preferably, the silicon content is such that: $1.4\% \leq Si \leq 1.7\%$.

Preferably, the aluminium content satisfies the relationship: $Al \leq 0.015\%$.

According to a preferred embodiment, the vanadium content is such that: $0.12\% \leq V \leq 0.15\%$.

Also preferably, the titanium content is such that: $Ti \leq 0.005\%$.

The subject of the invention is also a sheet of steel of the above composition, the microstructure of which consists of ferrite, bainite, residual austenite and, optionally, martensite.

According to a preferred embodiment, the microstructure of the steel has a residual austenite content of between 8 and 20%.

The microstructure of the steel preferably has a martensite content of less than 2%.

Preferably, the mean size of the residual austenite islands does not exceed 2 microns.

The mean size of the residual austenite islands preferably does not exceed 1 micron.

The subject of the invention is also a process for manufacturing a hot-rolled sheet exhibiting TRIP behaviour, in which:

- a steel according to any one of the above compositions is supplied;
- a semi-finished product is cast from this steel;
- said semi-finished product is raised to a temperature above 1200° C.;
- the semi-finished product is hot-rolled;
- the sheet thus obtained is cooled;
- the sheet is coiled, the temperature $T_{er}$ of the end of the hot rolling, the rate $V_c$ of the cooling and the temperature $T_{coil}$ of the coiling being chosen in such a way that the microstructure of the steel consists of ferrite, bainite, residual austenite and, optionally, martensite.

Preferably, the temperature $T_{er}$ of the end of the hot rolling, the rate $V_c$ of the cooling and the temperature $T_{coil}$ of the coiling are chosen in such a way that the microstructure of the steel has a residual austenite content of between 8 and 20%.

Also preferably, the temperature $T_{er}$ of the end of the hot rolling, the rate $V_c$ of the cooling and the temperature $T_{coil}$ of the coiling are chosen in such a way that the microstructure of the steel has a martensite content of less than 2%.

Preferably, the temperature $T_{er}$ of the end of the hot rolling, the rate $V_c$ of the cooling and the temperature $T_{coil}$ of the coiling are chosen in such a way that the mean size of the residual austenite islands does not exceed 2 microns, and very preferably is less than 1 micron.

The subject of the invention is also a process for manufacturing a hot-rolled sheet exhibiting TRIP behaviour, in which:

- the semi-finished product is hot rolled with an end-of-rolling temperature $T_{er}$ of 900° C. or higher;
- the sheet thus obtained is cooled at a cooling rate $V_c$ of 20° C./s or higher; and
- the sheet is coiled at a temperature $T_{coil}$ below 450° C.

Preferably, the coiling temperature $T_{coil}$ is below 400° C.

The subject of the invention is also a process for manufacturing a cold-rolled sheet exhibiting TRIP behaviour, in which a hot-rolled steel sheet manufactured according to any one of the methods described above is supplied, the sheet is pickled, the sheet is cold-rolled, and the sheet is made to undergo an annealing heat treatment, the heat treatment comprising a heating phase at a heating rate $V_{hs}$, a soak phase at a soak temperature $T_s$ for a soak time $t_s$ followed by a cooling phase at a cooling rate $V_{cs}$ when the temperature is below Ar3, followed by a soak phase at a soak temperature $T'_s$ for a soak time $t'_s$, the parameters $V_{hs}$, $T_s$, $t_s$, $V_{cs}$, $T'_s$ and $t'_s$ being chosen in such a way that the microstructure of said steel consists of ferrite, bainite, residual austenite and, optionally, martensite.

According to a preferred embodiment, the parameters $V_{hs}$, $T_s$, $t_s$, $V_{cs}$, $T'_s$ and $t'_s$ are chosen in such a way that the microstructure of the steel has a residual austenite content of between 8 and 20%.

Also preferably, the parameters $V_{hs}$, $T_s$, $t_s$, $V_{cs}$, $T'_s$ and $t'_s$ are chosen in such a way that the microstructure of the steel contains less than 2% martensite.

According to a preferred embodiment, the parameters $V_{hs}$, $T_s$, $t_s$, $V_{cs}$, $T'_s$ and $t'_s$ are chosen in such a way that the mean size of the residual austenite islands is less than 2 microns, very preferably less than 1 micron.

The subject of the invention is also a process for manufacturing a cold-rolled sheet exhibiting TRIP behaviour according to which the sheet is made to undergo an annealing heat treatment, the heat treatment comprising a heating phase at a heating rate $V_{hs}$ of 2° C./s or higher, a soak phase at a soak temperature $T_s$ of between $A_{c1}$ and $A_{c3}$ for a soak time $t_s$ of between 10 and 200 s, followed by a cooling phase at a cooling rate $V_{cs}$ of greater than 15° C./s when the temperature is below Ar3, followed by a soak phase at a temperature $T'_s$ of between 300 and 500° C. for a soak time $t'_s$ of between 10 and 1000 s.

The soak temperature $T_s$ is preferably between 770 and 815° C.

The subject of the invention is also the use of a sheet of steel exhibiting TRIP behaviour, according to one of the embodiments described above, or manufactured by one of the processes described above, for the manufacture of structural components or of reinforcing elements in the automobile field.

DETAILED DESCRIPTION

Further features and advantages of the invention will become apparent over the course of the description below, which is given by way of example.

With regard to the chemical composition of the steel, carbon plays a very important role in the formation of the microstructure and the mechanical properties. According to the invention, a bainitic transformation occurs from an austenitic structure formed at high temperature, and bainitic ferrite laths are formed. Owing to the very low solubility of carbon in ferrite compared with austenite, the carbon of the austenite is rejected between the laths. Thanks to certain alloying elements in the steel composition according to the invention, in particular silicon and manganese, the precipitation of carbides, especially cementite, hardly occurs. Thus, the interlath austenite becomes progressively enriched with carbon, without the precipitation of carbides occurring. This enrichment is such that the austenite is stabilized, that is to say that the martensitic transformation from this austenite does not occur on cooling down to room temperature. According to the invention, the carbon content is between 0.08 and 0.23% by weight. Preferably, the carbon content lies within a first range from 0.08 to 0.13% by weight. In a second preferred range, the carbon content is greater than 0.13% but does not exceed 0.18% by weight. The carbon content is within a third preferred range, in which this is greater than 0.18% but does not exceed 0.23% by weight.

Since carbon is a particularly important element for hardening, the minimum carbon content of each of the three preferred ranges makes it possible to achieve a minimum strength of 600 MPa, 800 MPa and 950 MPa on cold-rolled and annealed sheet, for each of the above respective ranges. The maximum carbon content of each of the three ranges makes it possible to guarantee satisfactory weldability, especially for spot welding, if the strength level obtained in each of these three preferred ranges is taken into account.

Adding manganese, an element inducing the gamma phase, in an amount of between 1 and 2% by weight contributes to reducing the martensite start temperature $M_s$ and to stabilizing the austenite. This addition of manganese also participates in effective solid-solution hardening and therefore in increasing the strength. The manganese content is preferably between 1.4 and 1.8% by weight: in this way satisfactory hardening is combined with improved stability of the austenite, without correspondingly causing excessive hardenability in welded assemblies. Optimally, the manganese content is between 1.5 and 1.7% by weight. In this way, the above desired effects are obtained without the risk of forming a deleterious banded structure, which would arise from any segregation of the manganese during solidification.

Silicon in an amount between 1 and 2% by weight inhibits the precipitation of cementite during cooling of the austenite, considerably retarding carbide growth. This stems from the fact that the solubility of silicon in cementite is very low, this element increasing the activity of the carbon in austenite. Any cementite seed forming will therefore be surrounded by an austenitic region rich in silicon, which will have been rejected at the precipitate/matrix interface. This silicon-enriched austenite is also richer in carbon and the growth of cementite is retarded because of the little diffusion, resulting from the low carbon gradient, between the cementite and the neighbouring austenite region. This addition of silicon therefore helps to stabilize a sufficient amount of residual austenite for obtaining a TRIP effect. Furthermore, this addition of silicon increases the strength by solid-solution hardening. However, an excessive addition of silicon causes the formation of highly adherent oxides, which are difficult to remove during a pickling operation, and the possible appearance of surface defects due especially to a lack of wettability in hot-dip galvanizing operations. To stabilize a sufficient amount of austenite, while still reducing the risk of surface defects, the silicon content is preferably between 1.4 and 1.7% by weight.

Aluminium is a very effective element for deoxidizing steel. Like silicon, it has a very low solubility in cementite and could be used in this regard to prevent the precipitation of cementite during a soak at a bainitic transformation temperature and to stabilize the residual austenite. However, according to the invention, the aluminium content does not exceed 0.030% by weight since, as will be seen below, very effective hardening is obtained by means of vanadium carbonitride precipitation. When the aluminium content is greater than 0.030%, there is a risk of aluminium nitride precipitating, which correspondingly reduces the amount of nitrogen capable of precipitating with the vanadium. Preferably, when this amount is equal to 0.015% by weight or less, any risk of aluminium nitride precipitating is eliminated and the full effect of the hardening by the vanadium carbonitride precipitation is obtained.

For the same reason, the titanium content does not exceed 0.010% by weight so as not to precipitate a significant amount of nitrogen in the form of titanium nitrides or carbonitrides. Owing to the high affinity of titanium for nitrogen, the titanium content preferably does not exceed 0.005% by weight. Such a titanium content therefore prevents the precipitation of (Ti,V)N in hot-rolled sheet.

Vanadium and nitrogen are important elements in the invention. The inventors have demonstrated that, when these elements are present in the amounts defined according to the invention, they precipitate in the form of very fine vanadium carbonitrides associated with substantial hardening. When the vanadium content is less than 0.1% by weight or when the nitrogen content is less than 0.004% by weight, the precipitation of vanadium carbonitrides is limited and the hardening is insufficient. When the vanadium content is greater than 0.25% by weight or when the nitrogen content is greater than 0.012% by weight, the precipitation occurs at an early stage after the hot rolling in the form of coarser precipitates. Owing to the size of these precipitates, the potential hardening of vanadium is not fully utilized, most particularly when it is intended to manufacture a cold-rolled and annealed steel sheet. In the latter case, the inventors have demonstrated that it is necessary to limit the precipitation of vanadium at the hot-rolling step so as to more fully utilize the fine hardening precipitation that occurs during a subsequent anneal. In addition, by limiting the vanadium precipitation at this stage it is possible to reduce the forces needed during the subsequent cold rolling and therefore optimize the performance of industrial installations.

When the vanadium content is between 0.12 and 0.15% by weight, the uniform elongation or the elongation at break is particularly increased.

Sulphur, in an amount of more than 0.015% by weight, tends to precipitate excessively in the form of manganese sulfides that greatly reduce the formability.

Phosphorus is an element known to segregate at grain boundaries. Its content must be limited to 0.1% by weight so as to maintain sufficient hot ductility and to promote failure by peel during tension-shear tests carried out on spot-welded assemblies.

Optionally, elements such as chromium and molybdenum, which retard the bainitic transformation and promote solid-solution hardening, may be added in amounts not exceeding 0.3 and 0.5% by weight, respectively. Optionally, niobium may also be added in an amount not exceeding 0.1% by weight so as to increase the strength by complementary carbonitride precipitation.

The process for manufacturing a hot-rolled sheet according to the invention is implemented as follows:

- a steel of composition according to the invention is supplied;
- a semi-finished product is cast from this steel, possibly as ingots or continuously in the form of slabs with a thickness of around 200 mm. The casting may also be carried out so as to form thin slabs a few tens of millimeters in thickness or thin strip between counter-rotating steel rolls;
- the cast semi-finished products are firstly heated to a temperature above 1200° C. in order to reach at all points a temperature favourable to the high deformations that the steel will undergo during the rolling and to prevent, at this stage, the formation of vanadium carbonitrides. Of course, in the case of direct casting of thin slab or thin strip between counter-rotating rolls, the step of hot rolling these semi-finished products, starting at above 1200° C., may be carried out directly after casting so that an intermediate reheating step is then unnecessary. As will be seen, this minimum temperature of 1200° C. also allows the hot rolling to be satisfactorily carried out in the entirely austenitic phase on a continuous hot-rolling mill; and
- the semi-finished product is hot rolled with an end-of-rolling temperature $T_{er}$ of 900° C. or higher. In this way, the rolling is carried out entirely in the austenitic phase in which solubility of vanadium carbonitrides is higher and in which the probability of V(CN) precipitation is decreased. For the same reason, the sheet thus obtained is then cooled at a cooling rate $V_c$ of 20° C./s or higher, so as to prevent vanadium carbonitrides from precipitating in the ferrite. This cooling may for example be carried out by means of a water spray on the sheet.

If it is desired to manufacture a hot-rolled sheet according to the invention, the sheet obtained is coiled at a temperature of 450° C. or below. In this way, the quasi-isothermal soak associated with this coiling operation results in the formation of a microstructure consisting of bainite, ferrite, residual austenite and, optionally, a small amount of martensite, and also leads to hardening vanadium carbonitride precipitation. When the coiling temperature is 400° C. or below, the total elongation and the uniform elongation are increased.

More particularly, the temperature $T_{er}$ of the end of hot rolling, the cooling rate $V_c$ and the coiling temperature $T_{coil}$ will be chosen in such a way that the microstructure has a residual austenite content of between 8 and 20%. When the amount of residual austenite is less than 8%, a sufficient TRIP effect cannot be demonstrated in mechanical tests. In particular, tensile tests show that the strain-hardening coefficient n is less than 0.2 and rapidly decreases with strain $\epsilon$. Considère's criteria applies to these steels and failure occurs when $n=\epsilon_{true}$, the elongation therefore being greatly limited. In the case of TRIP behaviour, the residual austenite is progressively transformed to martensite during deformation, n being greater than 0.2, and necking occurs for higher strains.

When the residual austenite content is greater than 20%, the residual austenite formed under these conditions has a relatively low carbon content and is destabilized too easily during a subsequent deformation or cooling phase.

Among the parameters $T_{er}$, $V_c$ and $T_{coil}$ chosen for obtaining a residual austenite amount of between 8 and 20%, the parameters $V_c$ and $T_{coil}$ are the more important ones:

the most rapid possible cooling rate $V_c$ will be chosen so as to prevent pearlitic transformation (which would go counter to obtaining a residual austenite content of between 8 and 20%), while still remaining within the controlled capabilities of an industrial line so as to obtain microstructural homogeneity in both the longitudinal and transverse directions of the hot-rolled sheet; and the coiling temperature will be chosen to be low enough to prevent pearlitic transformation. This would result in incomplete bainitic transformation and a residual austenite content of less than 8%.

Preferably, the parameters $T_{er}$, $V_c$ and $T_{coil}$ will be chosen in such a way that the microstructure of the hot-rolled steel sheet contains less than 2% martensite. Otherwise, the elongation is reduced, as is the absorption energy corresponding to the area under the tensile stress-strain ($\sigma$-$\epsilon$) curve. When martensite is present in an excessive amount, the resulting mechanical behaviour approaches that of a dual-phase steel with a high initial value of the strain-hardening coefficient n, which decreases when the deformation ratio increases. Optimally, the microstructure contains no martensite.

Among the $T_{er}$, $V_c$ and $T_{coil}$ parameters chosen for the purpose of obtaining a martensite content of less than 2%, the more important parameters are:

the cooling rate $V_c$, which must be as rapid as possible in order to prevent pearlitic transformation, but this cooling must not result in a temperature below $M_s$, the latter temperature denoting the martensite start temperature characteristic of the chemical composition of the steel used;

for the same reason, a coiling temperature above $M_s$ will be chosen;

also preferably, the parameters $T_{er}$, $V_c$ and $T_{coil}$ will be chosen in such a way that the mean size of the residual austenite islands of the microstructure does not exceed 2 microns. This is because when austenite is transformed to martensite by the lowering of the temperature or by deformation, martensite islands with a mean size of greater than 2 microns play a preferential role in damage, as a result of loss of cohesion with the matrix;

preferably, the parameters $T_{er}$, $V_c$ and $T_{coil}$ will more particularly be chosen in such a way that the mean size of the residual austenite islands of the microstructure does not exceed 1 micron, so as to increase their stability, to limit damage at matrix/island interfaces and to push necking back to higher deformation ratios.

For the purpose of obtaining fine residual austenite islands, the following will be chosen:

not too high an end-of-rolling temperature $T_{er}$ in the austenite region so as to obtain relatively fine austenite grain size before allotropic transformation; and the most rapid possible cooling rate $V_c$ in order to prevent pearlitic transformation.

To manufacture a cold-rolled sheet according to the invention, the process starts with the manufacture of a hot-rolled sheet according to one of the variants presented above. This is because the inventors have found that the microstructures and mechanical properties obtained for the manufacturing process involving cold rolling and annealing, which will be explained below, depend relatively little on the manufacturing conditions within the limits of the variants of the process that were explained above, in particular on variations in the coiling temperature $T_{coil}$. Thus, the process for manufacturing cold-rolled sheet has the advantage of being largely insensitive to fortuitous variations in the conditions for manufacturing hot-rolled sheet.

However, a coiling temperature of 400° C. or below will preferably be chosen, so as to keep more vanadium in solid solution, so as to be available for precipitation during the subsequent annealing of the cold-rolled sheet.

The hot-rolled sheet is pickled using a process known per se, so as to give it a surface finish suitable for the cold rolling. This is carried out under standard conditions, for example by reducing the thickness of the hot-rolled sheet by 30 to 75%.

An annealing treatment is then carried out suitable for recrystallizing the work-hardened structure and for giving the particular microstructure according to the invention. This treatment, preferably carried out by continuous annealing, comprises the following successive phases:

a heating phase with a heating rate $V_{hs}$ of 2° C./s or higher, up to a temperature $T_s$ lying within the intercritical region, that is to say a temperature between the transformation temperatures $A_{c1}$ and $A_{c3}$. The following are observed during this heating phase: recrystallization of the work-hardened structure; dissolution of the cementite; growth of the austenite above the transformation temperature $A_{c1}$; and precipitation of vanadium carbonitrides in the ferrite. These carbonitride precipitates are very small, typically having a diameter of less than 5 nanometers, after this heating phase.

When the heating rate is less than 2° C./s, the volume fraction of precipitated vanadium decreases. In addition, the productivity of the manufacture is excessively reduced; and a soak phase at an intercritical temperature $T_s$ of between $A_{C1}$ and $A_{C3}$ for a time $t_m$ of between 10 s and 200 s. Under these well-defined conditions, the inventors have demonstrated that the precipitation of vanadium carbonitrides in the ferrite continues practically without any precipitation in the newly formed austenitic phase. The volume fraction of precipitates increases in parallel with an increase in mean diameter of these precipitates. Thus, particularly effective hardening of the intercritical ferrite is obtained.

The sheet then undergoes rapid cooling at a rate $V_{cs}$ of greater than 15° C./s when the temperature is below Ar3. Rapid cooling when the temperature is below Ar3 is important so as to limit the formation of ferrite before the bainitic transformation. This rapid cooling phase when the temperature is below Ar3 may optionally be preceded by a slower cooling phase starting from the temperature $T_s$.

During this cooling phase, the inventors have demonstrated that there is practically no complementary precipitation of the vanadium carbonitrides in the ferritic phase.

Next, a soak at a temperature $T'_s$ is carried out between 300° C. and 500° C. for a soak time $t'_s$ of between 10 s and 1000 s. This therefore results in bainitic transformation and carbon enrichment of the residual austenite islands in such an amount that this residual austenite is stable even after cooling down to room temperature.

Preferably, the soak temperature $T_s$ is between 770 and 815° C.—there may be insufficient recrystallization below 770° C. Above 815° C., the fraction of intercritical austenite formed is too high and the hardening of the ferrite by vanadium carbonitride precipitation is less effective. This is because the intercritical ferrite content is less, as is the total amount of vanadium precipitated, vanadium being rather soluble in the austenite. Moreover, the vanadium carbonitride precipitates that form have a greater tendency to coarsen and to coalesce at high temperature.

According to a preferred method of implementing the invention, after the cold-rolling step, the sheet is made to undergo an annealing heat treatment, the parameters $V_{hs}$, $T_s$, $t_s$, $V_s$, $T'_s$, $t'_s$, of which are chosen in such a way that the microstructure of the steel obtained consists of ferrite, bainite and residual austenite, and optionally martensite. Advantageously parameters will be chosen such that the residual austenite content is between 8% and 20%. These parameters will preferably be chosen in such a way that the mean size of the residual austenite islands does not exceed 2 microns, and optimally does not exceed 1 micron. These parameters will also be chosen in such a way that the martensite content is less than 2%. Optimally, the microstructure contains no martensite.

To achieve these results, the choice of the parameters $T_s$, $t_s$, $V_{cs}$ and $T'_s$ is more particularly important:

- $T_s$, the temperature in the intercritical region between the transformation temperatures $A_{c1}$ and $A_{c3}$ (austenite start temperature and austenite finish temperature, respectively), must be chosen so as to obtain at least 8% austenite formed at high temperature. This condition is necessary so that the structure after cooling contains at least 8% residual austenite. However, the temperature $T_s$ must not be too close to $A_{c3}$ in order to avoid austenite grain growth at high temperature, which would consequently result in the residual austenite islands being too large;
- the time $t_s$ must be chosen to be long enough for the partial transformation to austenite to have time to occur;
- the cooling rate $V_{cs}$ must be sufficiently rapid to prevent the formation of pearlite, which would not allow the above intended results to be obtained; and
- the temperature $T'_s$ will be chosen so that the transformation of the austenite formed during the soak at the temperature $T_s$ is a bainitic transformation and it leads to carbon enrichment sufficient for this austenite formed at high temperature to be stabilized in an amount ranging between 8 and 20%.

The following results show, by way of non-limiting examples, the advantageous characteristics conferred by the invention.

Example 1

Steels with the composition given in the table below, expressed in percentages by weight, were smelted. Apart from steels Inv1 to Inv3 according to the invention, the composition of a reference steel R1 is given by way of comparison.

TABLE 1

Steel compositions in wt % (Inv = according to the invention; R = reference)

| Steel | C | Mn | Si | Al | V | Ti | S | P | N |
|---|---|---|---|---|---|---|---|---|---|
| Inv1 | 0.223 | 1.58 | 1.59 | <0.030 | 0.100 | 0.002 | <0.005 | <0.030 | 0.008 |
| Inv2 | 0.225 | 1.58 | 1.60 | <0.030 | 0.155 | 0.002 | <0.005 | <0.030 | 0.009 |
| Inv3 | 0.225 | 1.58 | 1.60 | <0.030 | 0.209 | 0.002 | <0.005 | <0.030 | 0.009 |
| R1 | 0.221 | 1.60 | 1.59 | <0.030 | 0.005 (*) | 0.002 | <0.005 | <0.030 | 0.001 (*) |

(*): not according to the invention.

Semi-finished products corresponding to the above compositions were reheated to 1200° C. and hot rolled in such a way that the rolling temperature was above 900° C. The 3 mm thick sheets thus obtained were cooled at a rate of 20° C./s by a water spray and then coiled at a temperature of 400° C. The tensile properties obtained (yield strength $R_e$, tensile strength $R_m$, uniform elongation Au and total elongation $A_t$) are given in Table 2 below. Also given is the ductile-brittle transition temperature determined by means of V-notched Charpy specimens of reduced thickness (e=3 mm). The table also indicates the residual austenite content measured by X-ray diffraction.

TABLE 2

Tensile property, transition temperature and residual austenite content of hot-rolled sheet

| Steel | $R_e$ (Mpa) | $R_m$ (MPa) | $A_u$ (%) | $A_t$ (%) | Transition temperature (° C.) | Residual austenite content (%) |
|---|---|---|---|---|---|---|
| Inv1 | 731 | 884 | 13 | 22 | n.d. | n.d. |
| Inv2 | 724 | 891 | 26 | 38 | −35 | n.d. |
| Inv3 | 755 | 916 | 24 | 36 | n.d. | 10.8 |
| R1 | 615 | 793 | 14 | 28 | 0 | <1% |

n.d. = not determined.

The sheets manufactured according to the invention have a very high tensile strength of substantially above 800 MPa for a carbon content of about 0.22%. Their microstructure is composed of ferrite, bainite and residual austenite, together with martensite in an amount less than 2%. In the case of steel Inv3 (10.8% residual austenite content), the carbon concentration of the residual austenite islands is 1.36% by weight. This means that the austenite is sufficiently stable to obtain a TRIP effect as shown by the behaviour observed during the tensile tests carried out on these steel sheets.

The sheet of reference steel R1, having a bainite-pearlite structure with a very low residual austenite content, does not exhibit TRIP behaviour. Its tensile strength is less than 800 MPa, i.e. a level considerably below that of the steels of the invention.

Steel Inv2 according to the invention also has excellent toughness, since its ductile-brittle transition temperature (−35° C.) is considerably lower than that of the reference steel (0° C.).

Example 2

Hot-rolled sheets 3 mm in thickness of steels Inv2 and R1 manufactured according to Example 1 were cold rolled down to a thickness of 0.9 mm. An annealing heat treatment was then carried out, comprising a heating phase at a rate of 5° C./s, a soak phase at a soak temperature $T_s$ of between 775 and 815° C. (these temperatures lying within the $A_{c1}$-$A_{c3}$ range) for a soak time of 180 s, followed by a first cooling phase at 6-8° C./s and then a cooling phase at 20° C./s in a range where the temperature is below Ar3, a soak phase at 400° C. for 300 s, in order to form bainite, and a final cooling phase at 5° C./s.

The microstructure thus obtained was observed, after etching with the Klemm etchant, which revealed the residual austenite islands. The mean size of these islands was measured by means of image analysis software.

In the case of reference steel R1, the mean island size was 1.1 microns. In the case of steel Inv2 according to the invention, the general microstructure was finer, with a mean island size of 0.7 microns. Furthermore, these islands were more equiaxed in character. In particular, in the case of steel Inv2, these characteristics reduced the stress concentrations at the matrix/island interfaces.

The mechanical properties after cold rolling and annealing are the following:

TABLE 3

Tensile properties of cold-rolled and annealed sheet

| Steel | Soak temperature $T_s$ | $R_e$ (MPa) | $R_m$ (MPa) | $A_t$ (%) |
|---|---|---|---|---|
| Inv2 | 775 | 630 | 1000 | 25 |
| | 795 | 658 | 980 | 28 |
| | 815 | 650 | 938 | 26 |
| R1 | 775 | 480 | 830 | n.d. |
| | 795 | 480 | 820 | 30 |
| | 815 | 470 | 820 | 30 |

n.d. = not determined.

Steel Inv2 manufactured according to the invention has a tensile strength of greater than 900 MPa. For a comparable soak temperature $T_s$, its strength is considerably higher than that of the reference steel.

The cold-rolled and annealed steels according to the invention have mechanical properties that are largely insensitive to small variations in certain manufacturing parameters, such as the coiling temperature and the annealing temperature $T_s$.

Thus, the invention makes it possible to manufacture steels exhibiting TRIP behaviour with an increased strength. Parts manufactured from steel sheet according to the invention are profitably used for the manufacture of structural components or reinforcing elements in the automotive field.

The invention claimed is:

1. A steel having a steel composition, comprising, the contents being expressed by weight:

0.08%≤C≤0.23%
1%≤Mn≤2%
1≤Si≤2%
Al≤0.030%
0.12%≤V≤0.25%
Ti≤0.010%
S≤0.015%
P≤0.1%,
and
0.008%≤N≤0.012%, the balance of the composition including iron and inevitable impurities resulting from the smelting, wherein said steel composition exhibits TRIP behavior and a microstructure of said steel includes ferrite with a precipitation of vanadium carbonitrides and a residual austenite content of between 8 and 20%, the mean size of the residual austenite islands being 2 microns or less.

2. The steel according to claim 1, wherein said steel composition comprises in content expressed by weight:
0.08%≤C≤0.13%.

3. The steel according to claim 1, wherein said steel composition comprises in content expressed by weight:
0.13%≤C≤0.18%.

4. The steel according to claim 1, wherein said steel composition comprises in content expressed by weight:
0.18%≤C≤0.23%.

5. The steel composition according to claim 1, wherein said steel composition comprises in content expressed by weight:
1.4%≤Mn≤1.8%.

6. The steel according to claim 1, wherein said steel composition comprises in content expressed by weight:
1.5%≤Mn≤1.7%.

7. The steel according to claim 1, wherein said steel composition comprises in content expressed by weight:
1.4%≤Si≤1.7%.

8. The steel according to claim 1, wherein said steel composition comprises in content expressed by weight:
Al≤0.015%.

9. The steel according to claim 1, wherein said steel composition comprises in content expressed by weight:
0.12%≤V≤0.15%.

10. The steel according to claim 1, wherein said steel composition comprises in content expressed by weight:
Ti≤0.005%.

11. The steel according to claim 1, wherein the microstructure of said steel has a martensite content of less than 2%.

12. The steel according to claim 1, wherein the mean size of the residual austenite islands does not exceed 1 micron.

13. The steel composition according to claim 1, further comprising in content expressed by weight Nb≤0.1%.

14. The steel composition according to claim 1, further comprising in content expressed by weight Mo≤0.5%.

15. The steel composition according to claim 1, further comprising in content expressed by weight Cr≤0.3%.

16. The steel according to claim 1, wherein the steel microstructure further includes bainite.

17. A method of using a steel composition as claimed in claim 1, for the manufacture of structural components or of reinforcing elements in the automobile field.

18. A process for manufacturing a hot-rolled sheet exhibiting TRIP behavior according to claim 1, comprising the steps of:

casting a semi-finished product;
raising said semi-finished product to a temperature above 1200° C.;
hot-rolling said semi-finished product to obtain a sheet;
cooling the sheet thus obtained;
coiling said sheet,
wherein the temperature $T_{er}$ of the end of said hot rolling, the rate $V_c$ of said cooling and the temperature $T_{coil}$ of said coiling are chosen in such a way that the microstructure of said steel consists of at least one of ferrite, bainite, residual austenite and martensite.

19. The process according to claim 18, wherein the temperature $T_{er}$ of the end of said hot rolling, the rate $V_c$ of said cooling and the temperature T coil of said coiling are chosen in such a way that the microstructure of said steel has a residual austenite content of between 8 and 20%.

20. The process according to claim 18, wherein the temperature $T_{er}$ of the end of said hot rolling, the rate $V_c$ of said cooling and the temperature $T_{coil}$ of said coiling are chosen in such a way that the microstructure of said steel has a martensite content of less than 2%.

21. The process according to claim 18, wherein the temperature $T_{er}$ of the end of said hot rolling, the rate $V_c$ of said cooling and the temperature $T_{coil}$ of said coiling are chosen in such a way that the mean size of the residual austenite islands does not exceed 2 microns.

22. The process according to claim 18, wherein the temperature $T_c$ of the end of said hot rolling, the rate $V_c$ of said cooling and the temperature $T_{coil}$ of said coiling are chosen in such a way that the mean size of the residual austenite islands does not exceed 1 micron.

23. The process for manufacturing a hot-rolled sheet according to claim 18, wherein the temperature $T_{er}$ of the end of said rolling is not less than 900° C., the rate $V_c$ of said cooling is not less than 20° C./s and the temperature $T_{coil}$ of said coiling is below 450° C.

24. The process according to claim 23, wherein the coiling temperature $T_{coil}$ is below 400° C.

25. The process according to claim 18, wherein the steel composition consists of at least one of ferrite, bainite and residual austenite.

26. The method of using a sheet of steel manufactured by the process of claim 18 for the manufacture of structural component or of reinforcing element in the automobile field.

27. A process for manufacturing a cold-rolled sheet, comprising the steps of:

supplying a hot-rolled steel sheet manufactured according to claim 18;

pickling said sheet;

cold-rolling said sheet; and subjecting said sheet to an annealing heat treatment, said heat treatment comprising a heating phase at a heating rate $V_{hs}$, a soak phase at a soak temperature $T_s$ for a soak time is followed by a cooling phase at a cooling rate $V_{cs}$ when the temperature is below Ar3, followed by a soak phase at a soak temperature $T'_s$ for a soak time $t'_s$ that wherein the parameters $V_{hs}$, $T_s$, $t_s$, $V_{cs}$, $T'_s$ and $t'_s$ are chosen in such a way that the microstructure of said steel includes ferrite with a precipitation of vanadium carbonitrides, and wherein said cold-rolled sheet exhibits TRIP behavior.

28. The process according to claim 27, wherein the parameters $V_{hs}$, $T_s$, $t_s$, $V_{cs}$, $T'_s$ and t' are chosen in such a way that the microstructure of said steel has a residual austenite content of between 8 and 20%.

29. The process according to claim 27, wherein the parameters $V_{hs}$, $T_s$, $t_s$, $V_{cs}$, $T'_s$ and t' are chosen in such a way that the microstructure of said steel has a martensite content of less than 2%.

30. The process according to claim 27, wherein the parameters $V_{hs}$, $T_s$, $t_s$, $V_{cs}$, $T'_s$ and t' are chosen in such a way that the mean size of the residual austenite islands is less than 2 microns.

31. The process according to claim 27, wherein the parameters $V_{hs}$, $T_s$, $t_s$, $V_{cs}$, $T'_s$ and t' are chosen in such a way that the mean size of the residual austenite islands is less than 1 micron.

32. The process for manufacturing a cold-rolled sheet exhibiting TRIP behavior according to claim 27, wherein said sheet is made to undergo an annealing heat treatment, said heat treatment comprising a heating phase at a heating rate $V_{hs}$ of 2° C./s or higher, a soak phase at a soak temperature $T_s$ of between $A_{c1}$ and $A_{c3}$ for a soak time is of between 10 and 200 s, followed by a cooling phase at a cooling rate $V_{cs}$ of greater than 15° C./s when the temperature is below Ar3, followed by a soak phase at a temperature $T'_s$ of between 300 and 500° C. for a soak time $t'_s$ of between 10 and 1000 s.

33. The process according to claim 32, wherein said soak temperature Ts is between 770 and 815° C.

34. The process according to claim 27, wherein the steel composition consists of at least one of ferrite, bainite and residual austenite.

* * * * *